US006910573B2

(12) United States Patent
Deans

(10) Patent No.: US 6,910,573 B2
(45) Date of Patent: Jun. 28, 2005

(54) DUAL CONTAINER BOTTLE

(76) Inventor: David M. Deans, 4255 Gatewood La. NW., Duluth, GA (US) 31779

( * ) Notice: Subject to any disclaimer, the term of this patent is extended or adjusted under 35 U.S.C. 154(b) by 50 days.

(21) Appl. No.: 10/701,769

(22) Filed: Nov. 5, 2003

(65) Prior Publication Data

US 2004/0211742 A1 Oct. 28, 2004

Related U.S. Application Data

(60) Provisional application No. 60/465,887, filed on Apr. 24, 2003.

(51) Int. Cl.[7] ..... B65D 25/08

(52) U.S. Cl. ..... 206/222; 222/129; 222/153.02

(58) Field of Search ..... 222/129, 153.01, 222/145.1, 80, 153.02; 206/222

(56) References Cited

U.S. PATENT DOCUMENTS

| | | | | |
|---|---|---|---|---|
| 3,410,444 | A | * 11/1968 | Morane | 206/219 |
| 3,443,726 | A | 5/1969 | Muller et al. | 222/80 |
| 3,802,604 | A | 4/1974 | Morane et al. | 222/83 |
| 4,195,731 | A | 4/1980 | Cavazza | 206/222 |
| 4,465,183 | A | 8/1984 | Saito et al. | 206/222 |
| 4,693,366 | A | 9/1987 | Goncalves | 206/222 |
| 4,722,449 | A | 2/1988 | Dubach | 215/235 |
| 4,757,916 | A | 7/1988 | Goncalves | 222/83 |
| 4,823,946 | A | 4/1989 | Stoeffler et al. | 354/319 |
| 4,898,293 | A | 2/1990 | Morel | 215/250 |
| 4,982,875 | A | 1/1991 | Pozzi et al. | 222/83 |
| 5,029,718 | A | 7/1991 | Rizzardi | 215/254 |
| 5,170,888 | A | 12/1992 | Goncalves | 206/222 |
| 5,533,994 | A | 7/1996 | Meyer | 604/416 |
| 5,647,481 | A | 7/1997 | Hundermark et al. | 206/219 |
| 5,685,845 | A | * 11/1997 | Grimard | 604/82 |
| 5,782,345 | A | 7/1998 | Guasch et al. | 206/222 |
| 6,068,396 | A | 5/2000 | Baudin | 366/130 |
| 6,073,803 | A | 6/2000 | Sturm et al. | 222/80 |
| 6,126,032 | A | 10/2000 | Herzog et al. | 220/501 |
| 6,135,275 | A | * 10/2000 | Kelders et al. | 206/221 |
| 6,148,996 | A | 11/2000 | Morinit | 306/222 |
| 6,244,433 | B1 | * 6/2001 | Vieu | 206/221 |
| 6,481,571 | B1 | * 11/2002 | Kelders et al. | 206/219 |
| 2002/0020636 | A1 | 2/2002 | Bergamini et al. | 206/219 |

* cited by examiner

*Primary Examiner*—David A. Scherbel
*Assistant Examiner*—Sonia N. Khaira
(74) *Attorney, Agent, or Firm*—Needle & Rosenberg, P.C.

(57) ABSTRACT

A post-mix container provided with an upper container body and a lower container body. The upper container body has a coverable first opening on a proximal end and the lower container body has a coverable second opening on a proximal end. The proximal ends of the upper and lower container bodies may be moved axially toward each other so that covering of the second opening in the lower container body is removed and then the covering of the first opening in the upper container body is removed, after which the contents of the upper and lower container bodies can be mixed with each other.

17 Claims, 1 Drawing Sheet

DUAL CONTAINER BOTTLE

The benefit of the priority of U.S. provisional patent application Ser. No. 60/465,887, filed Apr. 24, 2003, entitled "DUAL CONTAINER BOTTLE," is hereby claimed, and the specification thereof incorporated herein in its entirety by this reference.

FIELD OF THE INVENTION

The present invention relates generally to post-mix containers and, more specifically, to post-mix containers having dual containers integrated therein.

BACKGROUND OF THE INVENTION

There exists a need for post-mix containers, most notably, in the cosmetic, household products, health, and beverage markets. Generally, a post-mix container has independent vessels or storage compartments that can contain various combinations of liquids, powders, or pastes that are stored in a separated state until the user or consumer elects to combine and use the product. Post-mix containers are useful in applications where keeping product ingredients separate until utilization extends the storage life or enhances product effectiveness over a premixed product. Applications include, but are not limited to, storage of face creams, body lotions, skin cleaners, shampoos, conditioners, hair coloring, cleaning products, air fresheners, paints, vitamin drinks, power drinks, weight loss mixtures, fruit drinks, tonics, cocktails, baby formula, and milk beverages.

While many different approaches have attempted to address the demand for post-mix containers, most approaches utilize two separate containers that require the consumer to connect together before mixing. For example, U.S. Pat. No. 5,647,481 to Hundertmark et al. discloses a two-container design whereby the user must remove a screw-on cap at the top opening of the bottom container and then insert the bottom container into the top container before threading the two containers together in order to remove the plug in the bottom of the top container. Therefore, the disclosed two-container design is not assembled and shipped ready to use and, hence, needs assembly by the consumer before use.

Other post-mix containers that do not require consumer assembly before use are often not practical or cost effective to manufacture. For example, U.S. Pat. No. 6,126,032 to Herzog et al. discloses a two-component container with a stopper located in the opening of the bottom container. The stopper is ejected by an ejector as the bottom and top container are threaded together. However, the top container would have to either be filled from its top nozzle while the bottom container is inserted sufficiently to seal the bottom of the top container, or filled from the bottom with the bottom container being required to be inserted immediately following. In either case, the two-component container disclosed is not practical for mass production. A similar two-component container with a single plug is disclosed in U.S. Pat. No. 3,443,726, to Muller et al. The disclosed container has a single plug, with a knockout portion therein, that seals the top container. Since the bottom container is not sealed until it is mated with the top container, the two containers must be connected promptly after filling.

Accordingly, a long felt need exist for a post-mix container that has independently sealed compartments; needs no assembly by the consumer before use; is intuitive to use; can be filled, assembled, and shipped ready to use; is tamper resistant; is reliable and does not leak when mixing the contents; can be provided with a means to prevent the separation of the containers after post-mixing; and is cost effective to mass produce.

SUMMARY OF THE INVENTION

The present invention relates to a post-mix container comprised of an upper container body having a proximal end that has a first opening and a removable first cover for the first opening. The first cover has a protrusion extending through the first opening such that the first cover may be pushed into the upper container body if a first force is applied to the protrusion of the first cover.

Furthermore, the invention comprises a lower container body having a second opening at a proximal end. Extending from the second opening is a collar that is dimensioned to fit within the first opening in the upper container body. In addition, the collar has an interior opening sufficiently large to receive therein the protrusion of the first removable cover. Moreover, a removable second cover for the second opening of the lower container body is provided. The second cover may be pushed into the lower container body if a second force is applied to the second cover. The second force is less than the first force.

In use, the proximal ends of the upper and lower container bodies may be moved axially toward each other such that the protrusion of the first cover enters the collar and thereafter comes in contact with the second cover. As the upper and lower container bodies continue to move axially toward each other, the second cover is pushed into the lower container body by the protrusion. Thereafter, the collar comes in contact with the first cover. As the upper and lower container bodies continue to move axially toward each other the first cover is pushed into the upper container body, thereby allowing the contents of the two container bodies to be mixed with each other.

It is to be understood that both the foregoing general description and the following detailed description are exemplary and explanatory only and are not restrictive of the invention, as claimed.

BRIEF DESCRIPTION OF THE DRAWINGS

The accompanying drawings illustrate one or more embodiments of the invention and, together with the written description, serve to explain the principles of the invention. Wherever possible, the same reference numbers are used throughout the drawings to refer to the same or like elements of an embodiment, and wherein.

DETAILED DESCRIPTION

Figure 1:
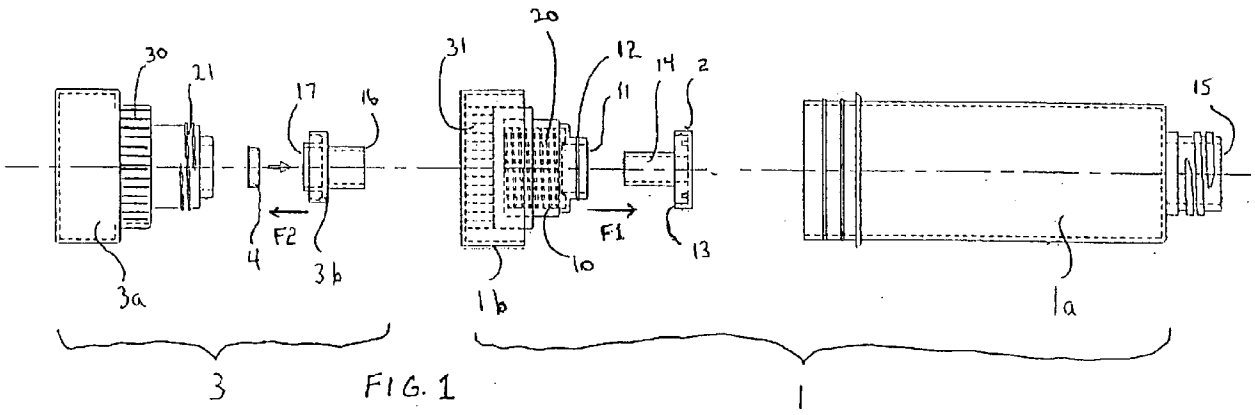
FIG. 1 is a side view of a post-mix container.

In the exemplary embodiment of the invention illustrated in FIG. 1 (not to scale) a post-mix container has an upper container body 1 having two body parts 1*a* and 1*b* that may be sealably joined together to form the upper container body 1. Although the upper container body is shown with two body parts, it is anticipated that a greater number of body parts may be provided, or only a single body part may be provided, if so desired.

As shown in FIG. 1, a recess 10 is provided on a proximal end of the upper container body 1. Located on a distal end of the recess 10 is a first opening 11. A lip portion 12, that is interior to the upper container body 1, is provided around the first opening 11. A removable first cover 2 is a cap 13 that is provided for the first opening 11. In addition, the removable first cover 2 has a protrusion 14 that can extend through the first opening 11. The cap 13 snap-fits over the lip portion 12 of the first opening 11, creating a cooperating snap means for releasably retaining the cap 13 over the lip portion 12. The cooperating snap means thereby establishes a first force F1 necessary to push the cover 2 into the upper container body 1. Although a snap means is provided in the embodiment shown in FIG. 1, it is anticipated that other fit means may be provided to establish the first force necessary to push the removable first cover 2 into an upper container body. In the embodiment described, the cap 13 may be fit over the lip portion 12 of the first opening 11 before joining the upper body parts 1*a* and 1*b*. Alternatively, if the upper container body 1 is formed as a single unit, the cover 2 may be inserted into the upper container body through dispensing opening 15 and put in place over opening 11 using, for example, a tool that can extend cover 2 inside the upper body container 1 to reach opening 11.

Still referring to FIG. 1, the post-mix container is provided with a lower container body 3 having two lower body parts 3*a* and 3*b* that may be sealably joined together to form the lower container body 3. Although the lower container body shown in FIG. 1 is provided with two lower body parts, it is anticipated that a greater or lesser number of lower body parts may be provided, if so desired. Moreover, it is anticipated that contents may be introduced into the lower container body 3 before joining the lower body parts 3*a* and 3*b*.

In addition, FIG. 1 shows that the lower body part 3*b* has a collar portion 16 that extends from a second opening 17, which is at a proximal end of the lower container body 3. The collar portion 16 is dimensioned to fit within the first opening 11 in the upper container body 1 and also has an interior opening sufficiently large to receive therein the protrusion 14 of the removable first cover 2. Furthermore, the dimensions of the outer surface of the collar 16 extending from the second opening 17 and of the interior of the first opening 11 may be substantially the same, such that when the collar 16 is inserted within the first opening 11 a seal is maintained so that the contents of the upper container body 1 and lower container body 3 do not escape from the interior of the two containers. Moreover, at least a portion of the proximal end of the lower container body 3, including the collar 16, may fit within the recess 10 of the proximal end of the upper container body 1.

Next, FIG. 1 illustrates a removable second cover 4 that may be inserted in the second opening 17. Furthermore, the plug 4 may be inserted in the second opening 17 before joining the lower body parts 3*a* and 3*b* to form the lower container body 3. The plug 4 inserted in the second opening 17 establishes a second force F2 required to push the plug 4 into the lower container body 3, the second force being less than the first force.

Still referring to FIG. 1, the interior of the recess 10 is provided with a threaded portion 20 that cooperates with a threaded portion 21 provided on the exterior portion of the proximal end of the lower container body 3. The proximal end of the lower body container 3 may be inserted into the recess 10 of the upper body container 1, and the upper and lower container bodies may be joined together by screwing together of the cooperating threaded portions 20, 21, which will cause axial movement of the upper and lower container bodies toward each other while aligning the openings 11, 17.

The embodiment of the container so far described is illustrative of one of many possible designs that incorporate the present invention. For instance the recess in the container bodies may be reversed, such that a proximal end of the lower container body has a recess, wherein the second opening is at a distal end of the recess. At least a portion of the proximal end of the upper container body, including a protrusion of the first cover, fits within the recess of the proximal end of the lower container body. In addition, the interior of the recess in the proximal end of the lower container body and the exterior portion of the proximal end of the upper container body that fits within the recess may have cooperating threaded portions, such that the upper and lower container bodies may be joined together, and, furthermore, that axial movement of the upper and lower container bodies toward each other may be caused by continued screwing together of the cooperating threaded portions.

Alternatively, it is also anticipated that other means may be provided to cause the axial movement of the two container bodies together. For example, the upper and lower container bodies may be caused to move axially toward each other by applying a compressive force.

Referring again to FIG. 1, as the upper and lower container bodies move axially toward each other, the protrusion 14 of the first cover 2 enters the interior of the collar portion 16 and comes in contact with the plug 4, thereby causing the plug 4 to be pushed into the lower container body 3. Although a force is applied to the first cover 2 when the protrusion 14 contacts the plug 4, the cooperating snap means causes the first force F1 to be larger than the second force F2 necessary to remove plug 4, such that the first cover 2 is not yet pushed into the upper container body 1. Next, when the collar portion 16 comes in contact with the cap 13, sufficient force is applied to cause the cover 2 to be pushed into the upper container body 1, thereby allowing the contents of the upper and lower container bodies to be mixed with each other.

Furthermore, the post-mix container shown in FIG. 1 may be provided with a cooperating ratchet means 30 on the exterior of the proximal end of the lower container body 3 and 31 on the interior of the proximal end of the upper container body 1. The cooperating ratchet means allows the upper and lower container bodies to be screwed together while impeding the ability to unscrew the upper and lower container bodies, thereby preventing the unintended opening of the post-mix container and the spilling of the contents.

Figure 2:
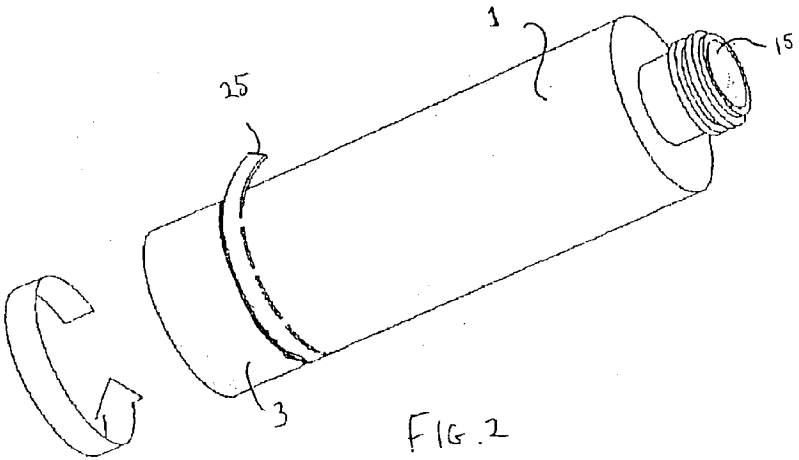
FIG. 2 is a perspective view of the post-mix container of FIG. 1.

In addition, the post-mix container may be provided with a removable means for preventing the upper and a lower container bodies from being moved axially toward each other, thereby preventing unintended opening of the containers and mixing of the contents of the upper and lower container bodies. When the removable means is provided, the consumer must first remove the removable means before axially moving the upper and lower container bodies toward each other in order to cause the covers 2, 4 provided with the upper and lower container bodies to be pushed out. As shown in FIG. 2 (not to scale), the removable means may be a removable strip 25 at the proximal end of upper container body 1 to block the axial movement of lower container body 3 with respect to the upper container body 1. While the removable strip is at the proximal end of the upper container body 1 in FIG. 2, it is anticipated that a removable strip may be at a proximal end of the lower container body, if so desired, to block an axial movement of an upper container body with respect to the lower container body. In addition, the removable means may also serve as an indicator that the contents in the post-mix container are unused and unmixed.

Moreover, FIGS. 1 and 2 show the upper container body 1 with a dispensing opening 15. While the post mix container shown in FIGS. 1 and 2 has a dispensing opening provided on the upper container body 1, the post-mix container may alternatively have a lower container body that has a dispensing opening, if so desired. The dispensing opening may receive a cover or spout of the many types known in the prior art (not shown) to allow the user to dispense the mixed contents for their intended use.

The invention allows lower and upper container bodies to be distributed either disconnected from each other or partially connected as a single unit. By providing for the possibility of disconnected container bodies before use, customers can have the option of selecting among different contents to be mixed, such as different colors in hair dyes.

It is anticipated that the post-mix container can be fabricated using conventional materials and manufacturing methods. The materials used will vary depending on the application and ph (alkaline or acidic) of the intended contents. The basic design will accommodate a wide range of liquids, powders, pastes and capacities.

It will be apparent to those skilled in the art that various modifications and variations can be made in the present invention without departing from the scope or spirit of the invention. Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A dual container bottle comprising:

an upper container body having a proximal end that has a first opening;

a removable first cover for the first opening, said first cover having a protrusion extending through said opening such that said first cover may be pushed into said upper container body if a first force is applied to the protrusion of said first cover;

a lower container body having a second opening at a proximal end, further comprising a collar extending from the second opening wherein said collar is dimensioned to fit within the first opening in said upper container body and said collar also has an interior opening sufficiently large to receive therein the protrusion of said removable first cover;

a removable second cover for the second opening of said lower container body such that said second cover may be pushed into said lower container body if a second force is applied to it, wherein the second force is less than the first force;

wherein, the proximal ends of said upper and lower container bodies may be moved axially toward each other such that, sequentially, first, the protrusion of said first cover enters said collar and comes in contact with said second cover, causing said second cover to be pushed into said lower container body, and, second, said collar comes in contact with said first cover, causing said first cover to be pushed into said upper container body, thereby allowing the contents of the two container bodies to be mixed with each other.

2. The dual container bottle of claim 1, wherein:

the proximal end of said upper container body has a recess, wherein the first opening is at the distal end of said recess;

at least a portion of the proximal end of said lower container body, including said collar, fits within the recess of the proximal end of said upper container body.

3. The dual container bottle of claim 2, wherein the interior of the recess in the proximal end of said upper container body and the exterior of the portion of the proximal end of said lower container body that fits within the recess have cooperating threaded portions, such that the upper and lower container bodies may be joined together, and, furthermore, that axial movement of the upper and lower container bodies toward each other may be caused by continued screwing together of the cooperating threaded portions.

4. The dual container bottle of claim 1, wherein:

the proximal end of said lower container body has a recess, wherein the second opening is at the distal end of said recess; at least a portion of the proximal end of said upper container body, including the protrusion of said first cover, fits within the recess of the proximal end of said lower container body.

5. The dual container bottle of claim 4, wherein the interior of the recess in the proximal end of said lower container body and the exterior of the portion of the proximal end of said upper container body that fits within the recess have cooperating threaded portions, such that the upper and lower container bodies may be joined together, and, furthermore, that axial movement of the upper and lower container bodies toward each other may be caused by continued screwing together of the cooperating threaded portions.

6. The dual container bottle of claim 1, wherein the first opening in said upper container body comprises a lip portion interior to said upper container body, and wherein said first cover comprises a cap that fits over the lip portion of the first opening.

7. The dual container bottle of claim 6, wherein said lip portion and said cap comprise cooperating snap means for releasably retaining said cap over said lip, thereby establishing said first force necessary to push said cap into the upper container body.

8. The dual container bottle of claim 3, further comprising cooperating ratchet means on the exterior of the proximal end of the lower container body and the interior of the proximal end of the upper container body for allowing the two containers to be screwed together while impeding the ability to unscrew the containers.

9. The dual container bottle of claim 1, wherein the dimensions of the outer surface of the collar extending from the second opening and of the interior of the first opening are substantially the same, such that when said collar is inserted within the first opening a seal is maintained so that the contents of the two container bodies do not escape from the interior of the two containers.

10. The dual container bottle of claim 1, further comprising removable means for preventing said upper and lower container bodies from being moved axially toward each other to cause the covers to be pushed open unless said means is removed, thereby preventing unintended mixing of the contents of the container bodies.

11. The dual container bottle of claim 10, wherein said prevention means comprises a removable strip at the proximal end of said upper container body, said strip being positioned to block the axial movement of the lower container body with respect to the upper container body.

12. The dual container bottle of claim 10, wherein said prevention means comprises a removable strip at the proximal end of said lower container body, said strip being positioned to block the axial movement of the upper container body with respect to the lower container body.

13. The dual container bottle of claim 1, wherein said upper container body also has a dispensing opening.

14. The dual container bottle of claim 1, wherein said lower container body also has a dispensing opening.

15. The dual container bottle of claim 6, wherein said upper container body comprises at least two body parts that may be sealably joined together to form said upper container body, such that said cap may fit over the lip portion of the first opening prior to joining the upper body parts.

16. The dual container bottle of claim 1, wherein said lower container body comprises at least two body parts that may be sealably joined together to form said lower container body, such that contents may be introduced into said lower container body prior to joining the lower body parts.

17. The dual container bottle of claim 16, wherein one of the lower container body parts comprises the collar portion of said lower container, and said second removable cover comprises a plug that may be inserted in the distal end of the collar prior to joining the part containing the collar to the other lower container body parts.

* * * * *